US010239663B2

(12) United States Patent
Rosenbaum et al.

(10) Patent No.: US 10,239,663 B2
(45) Date of Patent: Mar. 26, 2019

(54) HANDHELD SHAKER BOTTLE WITH DISPENSING CAP

(71) Applicants: Neil Rosenbaum, Fayetteville, NY (US); Fred Marconi, Erieville, NY (US); Scott Ryan, Skaneateles, NY (US)

(72) Inventors: Neil Rosenbaum, Fayetteville, NY (US); Fred Marconi, Erieville, NY (US); Scott Ryan, Skaneateles, NY (US)

( * ) Notice: Subject to any disclaimer, the term of this patent is extended or adjusted under 35 U.S.C. 154(b) by 24 days.

(21) Appl. No.: 15/422,075

(22) Filed: Feb. 1, 2017

(65) Prior Publication Data

US 2017/0217647 A1 Aug. 3, 2017

Related U.S. Application Data

(60) Provisional application No. 62/290,024, filed on Feb. 2, 2016.

(51) Int. Cl.

| | |
|---|---|
| ***B65D 83/06*** | (2006.01) |
| ***B65D 25/28*** | (2006.01) |
| ***B65D 47/26*** | (2006.01) |
| ***B65D 47/30*** | (2006.01) |

(52) U.S. Cl.

CPC ..... *B65D 25/2894* (2013.01); *B65D 47/265* (2013.01); *B65D 47/305* (2013.01); *B65D 83/06* (2013.01)

(58) Field of Classification Search

CPC ..... A47G 19/24
USPC ..... 222/556, 457.5, 142.1, 196.1, 196.2
See application file for complete search history.

(56) References Cited

U.S. PATENT DOCUMENTS

| | | | | |
|---|---|---|---|---|
| 1,767,742 | A * | 6/1930 | Case | A47G 19/24 222/531 |
| 5,193,722 | A * | 3/1993 | Groya | B65D 47/046 220/832 |
| 5,873,478 | A * | 2/1999 | Sullivan | A47G 19/2266 215/389 |
| 5,890,628 | A * | 4/1999 | Simpson | B65D 51/1644 222/131 |
| 6,439,442 | B1 * | 8/2002 | Markert | B65D 47/286 215/322 |
| 7,445,169 | B2 * | 11/2008 | Young | A01C 7/02 222/532 |
| 7,500,622 | B2 * | 3/2009 | Golding | B65D 25/30 220/711 |
| 9,222,231 | B2 * | 12/2015 | Marconi | A01M 9/0046 |
| 2013/0001332 | A1 * | 1/2013 | Marconi, Jr. | A01C 7/02 239/657 |
| 2014/0263484 | A1 * | 9/2014 | Marconi | A01M 9/0046 222/637 |

* cited by examiner

*Primary Examiner* — Patrick M Buechner
*Assistant Examiner* — Michael J Melaragno
(74) *Attorney, Agent, or Firm* — Bond Schoeneck and King PLLC; David Nocilly; George McGuire

(57) ABSTRACT

A handheld container for dispensing particulate matter having an opening and a moveable cover for the opening positioned at the bottom of the container. The cover has a pivoting lid that can selectively open or close the opening of the container and assist with dispersal of particulate from the container while a user holds the container in an upright position. The lid may swing outward from the container or hinge into an open position and include a series of ribs for improving the dispersal of particulate.

4 Claims, 7 Drawing Sheets

HANDHELD SHAKER BOTTLE WITH DISPENSING CAP

CROSS-REFERENCE TO RELATED APPLICATIONS

The present application claims priority to U.S. Provisional Application No. 62/290,024 filed on Feb. 2, 2016.

BACKGROUND OF THE INVENTION

1. Field of the Invention

The present invention relates to particulate containers and, more specifically, to a a dispensing cap for manually dispensing particular from the container.

2. Description of the Related Art

Granular products, such as fertilizer and ice melting chemical, are typically dispensed from handheld containers by inverting the bottle, opening the cap of the container, and then shaking the container to distribute particular from the opening of the bottle. Even if the container has a handle, dispensing product can be difficult as the container must be held in an unnatural position. Accordingly, there is a need in the art for a dispensing system that is easier to use.

BRIEF SUMMARY OF THE INVENTION

The present invention is a dispensing cap for a container that holds particulate that improves the distribution of particulate from the container. In one embodiment, the dispensing cap comprises a base configured for removable attachment to a mouth of the container and having a port formed therethough for restricting the flow of particulate out of the container and a cover pivotally mounted to the base and moveable between a first position, wherein the cover prohibits particular matter from exiting port of the base and a second position, wherein the cover permits particular matter to exit the post of the base. The base of the dispending cap extends along a first plane defined by the mouth of the container and the cover is coupled to the base via a pivot so that the cover pivots along a second plane that is parallel to the first plane. The cover includes a channel that is misaligned with the port when the cover is in the first position and is aligned with the port of the base when the cover is in the second position. The cover may also be dimensioned to extend beyond the container to which base is attached when it is in the second position. The cover can include a series of ribs extending from a first position positioned proximately to the mouth of the container to a second portion positioned proximately to a peripheral edge of the cover. The series of ribs define a path for the flow of particulate that is parallel to the first plane. The cover may further include a dimple positioned between the series of ribs to redirect particulate that flows from the mouth of the container and across the cover.

In another embodiment, the dispensing cap of the present invention comprises a base configured for removable attachment to a mouth of the container and having a port formed therethough for restricting the flow of particulate out of the container and a cover coupled to the base via a hinge so that the cover extends along a second plane that is perpendicular to the first plane in a closed position and extends along a third plane that is parallel to the first plane when the cover is in the open position. The cover has a first portion defining the hinge that couples the cover to the base and a second portion that extends perpendicularly from the first position to define a scoop that is positioned against a sidewall of the container when the cover is in the first position. The first portion of the cover includes a barrel that is positioned inside a cavity of the base and rotatable therein. The he cavity includes a first slot in communication with the mouth of the container and the barrel includes a second slot formed therethrough that is misaligned with the first slot when the cover is in the first position and is aligned with the first slot when the cover is in the second position. A series of ribs may be formed in the second portion of the cover.

The present invention also includes a method of dispensing particulate from a container, comprising the steps of providing a dispensing cap on a mouth of the container, wherein the dispensing cap includes a base having a port formed therethough for restricting the flow of particulate out of the container and a cover pivotally mounted to the base for movement between a first position, wherein the cover prohibits particular matter from exiting port of the base and a second position, wherein the cover permits particular matter to exit the post of the base, moving the cover from the first position to the second position to at least partially open the container via the port of the base, positioning the container so that the mount of the container is pointed downwardly and gravity will feed any particulate in the container through the port of the base, and then gently shaking the container to distribute particulate through the port of the base onto the cover of the dispensing cap. The step of moving the cover from the first position to the second position may comprise pivoting the cap along a plane that extending parallel to the mount of the container. The step of moving the cover from the first position to the second position may instead comprise pivoting the cap from engagement with a side of the container so that it the cap extends outwardly from the container.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
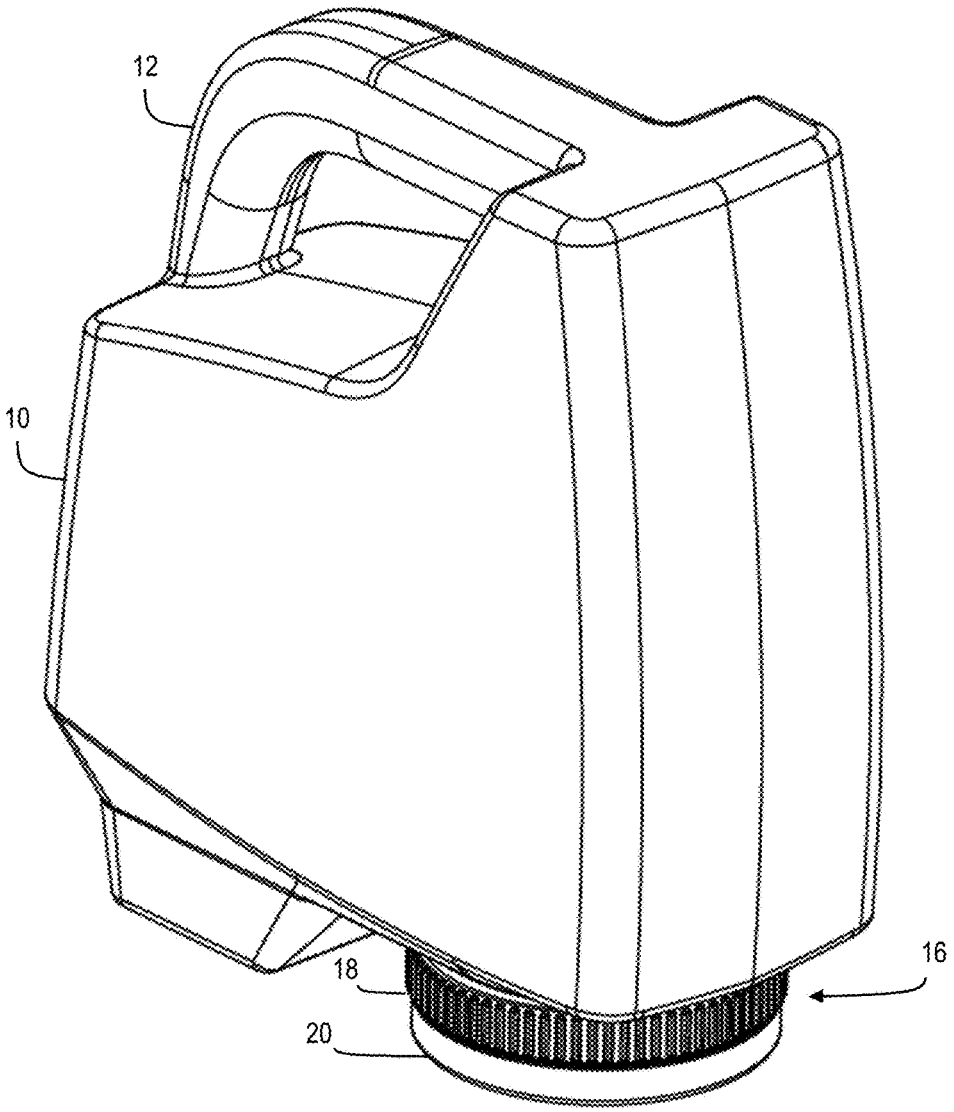
FIG. 1 is a perspective view of an embodiment of a particular container having a dispensing cap in a closed position according to the present invention.

Referring now to the drawings, wherein like reference numerals refer to like parts throughout, there seen in FIG. 1 a container 10 for holding and dispensing particulate matter. Container 10 includes a handle 12 and an opening 14 covered by a dispensing cap 16. Handle 12 and opening 14 are positioned about container 10 so that opening 14 faces downward when a user is holding handle 12 and container 10 is in an upright position, thus allowing gravity to assist with the flow of particulate out of container 10 through opening 14. A dispensing cap 16 comprising a base 18 may be removably coupled to container 10, such as via corresponding threads on the interior of base 18 and the exterior of opening 14. Dispensing cap 16 includes a cover 20 that is pivotally mounted to base 18 for movement between a closed position and a dispensing position.

Figure 2:
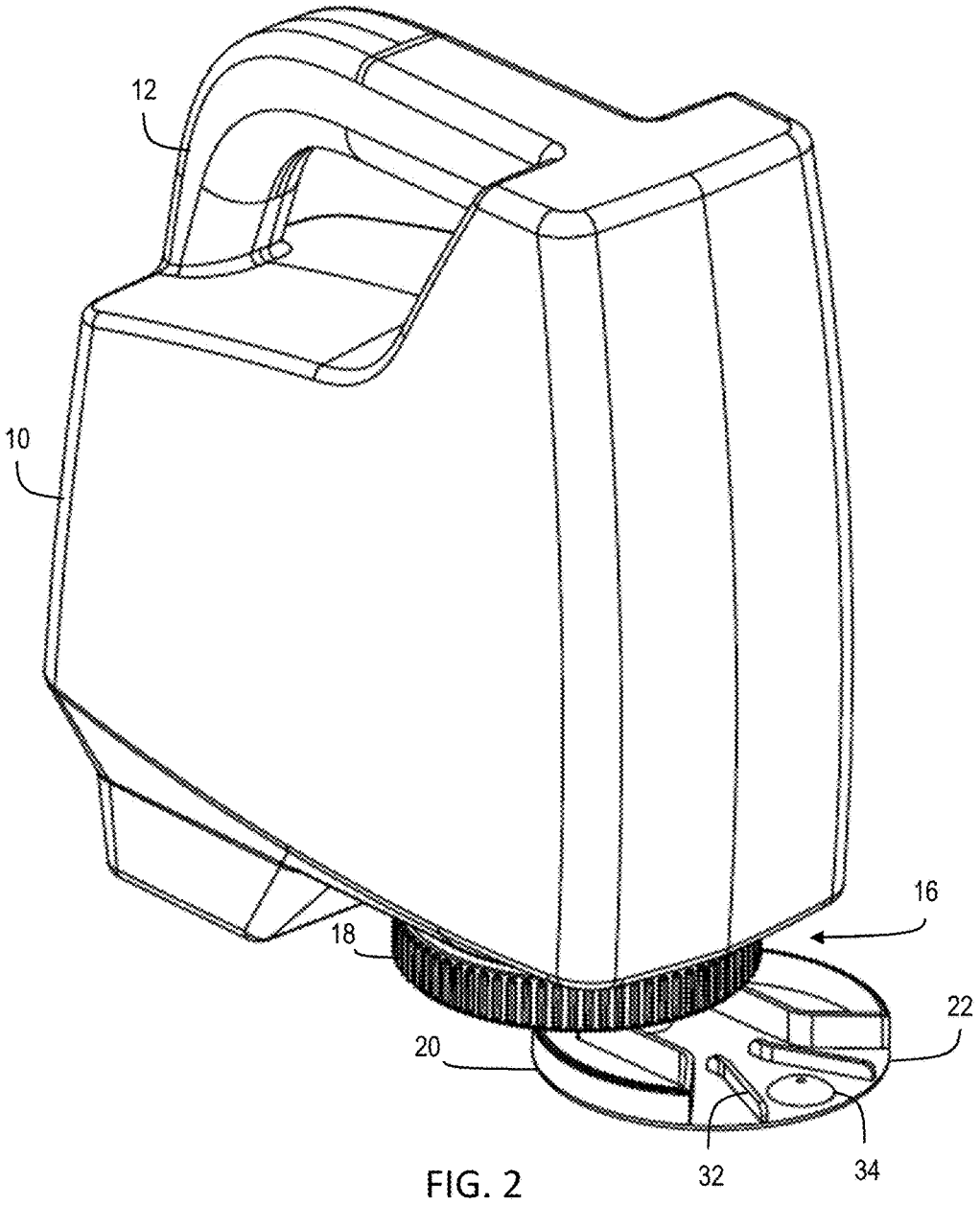
FIG. 2 is a perspective view of an embodiment of a particular container having a dispensing cap in an open position according to the present invention.
Figure 3:
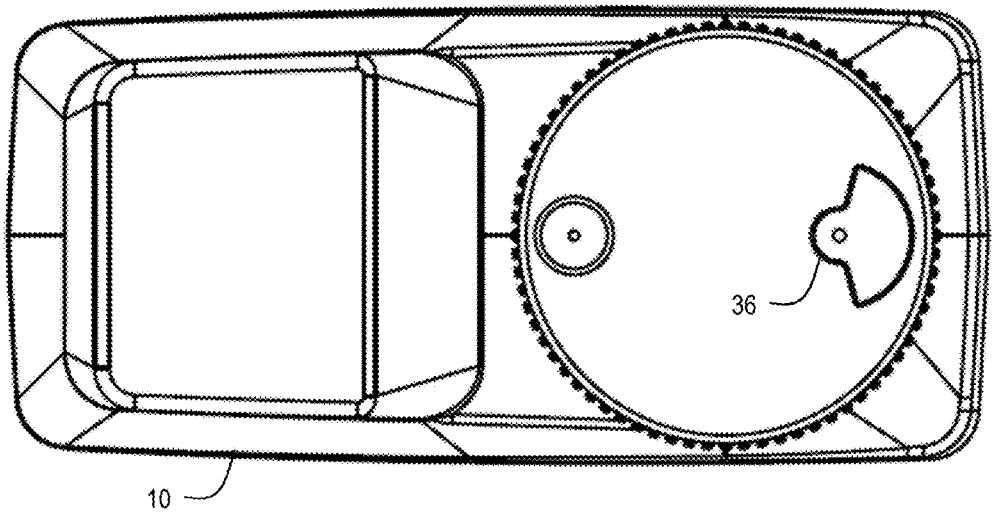
FIG. 3 is bottom view of an embodiment of a particular container having a dispensing cap in a closed position according to the present invention.
Figure 4:
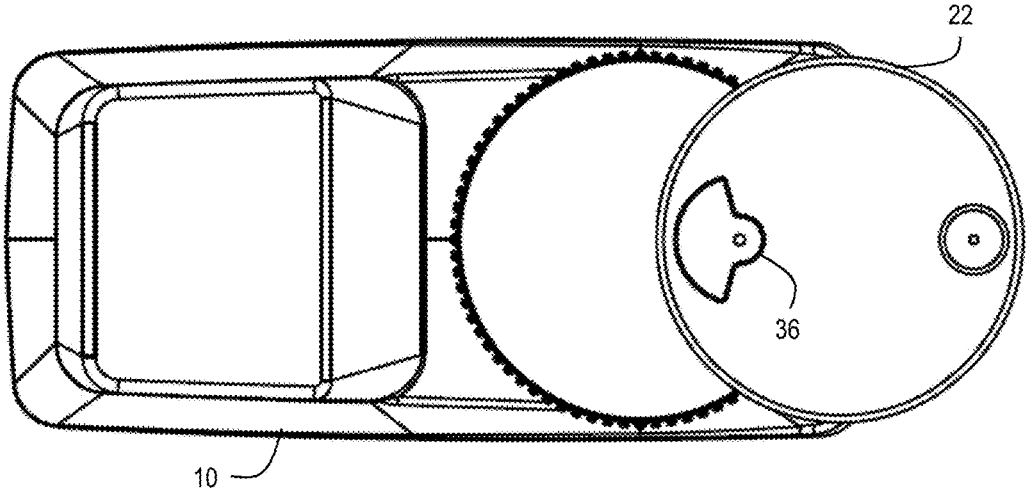
FIG. 4 is bottom view of an embodiment of a particular container having a dispensing cap in an open position according to the present invention.
Figure 5:
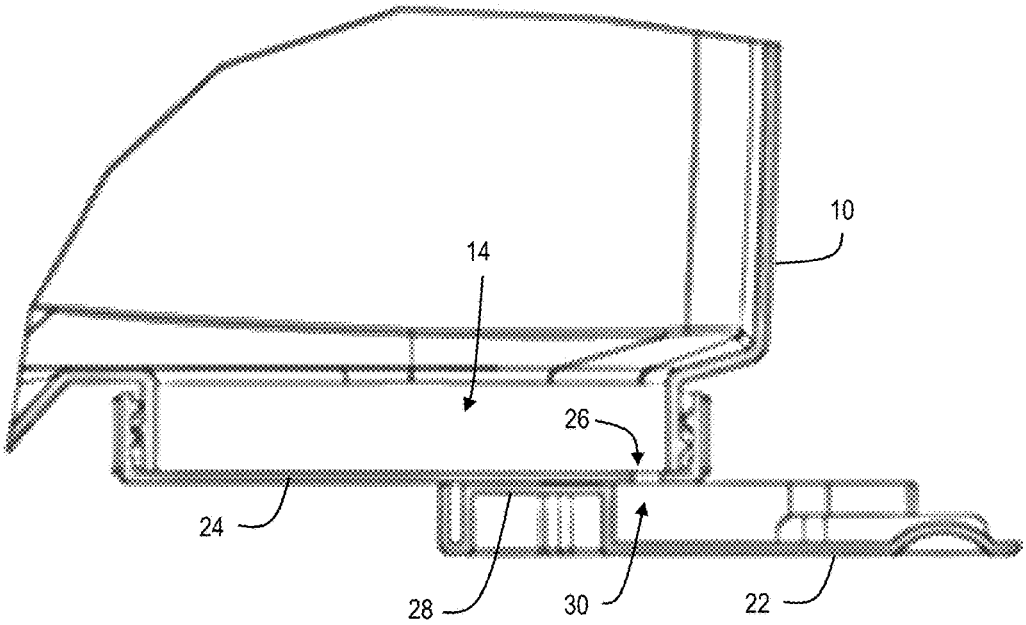
FIG. 5 is a cross section of a particular container having a dispensing cap according to the present invention.

Referring to FIG. 2, in a first embodiment, cover 20 of dispensing cap 16 comprises a disk 22 coupled to base 18 by a pivot 36. As seen in FIG. 5, base 18 includes a body 24 defining a port 26 formed therethrough that is dimensioned to regulate the amount of particulate that can flow to cover 20. Disk 22 includes a first portion 28 that blocks port 26 when cover 20 in the closed position, and a channel 30 that is in communication with port 26 when cover 20 in in the open position. As seen in FIGS. 2 and 4, disk 22 is pivotal through a plane that is parallel to the plane of body 24 of base 18 to extend outwardly from container 10. Disk 22 further includes a series of ribs 32 and a central dimple 34 positioned along the plane of disk 22 that are in communication with channel 30 to guide particulate flowing through port 26 across the exposed width of cover 20 and thus improve dispersal. Cover 20 may be thus moved between a first position, as seen in FIGS. 1 and 3, where cover 20 prevents any particulate held within container 10 from exiting through opening 14, and a second position, as seen in FIGS. 2 and 4, where cover 20 extends outwardly from container 10 and allows any particulate in container 10 to exit opening 14 and be dispensed across the extended portion of cover 20. When cover 20 is pivoted into the open position, particulate may be dispensed from container 10 while it is in the upright position via a combination of gravity and shaking of container 10 by a user that is holding handle 12. User can simply open cover 20 and does not also to invert container 10. As a result, container 10 can be held in a more ergonomic position, placing less strain on the hands and arm of a user. In addition, the extension of cover 20 beyond container 10 when placed into the open position allows for particulate to be spread more evenly from container 10 and to be more easily directed under an object, such as a car tire, ledge, or stair, and similar difficult to reach locations.

Figure 6:
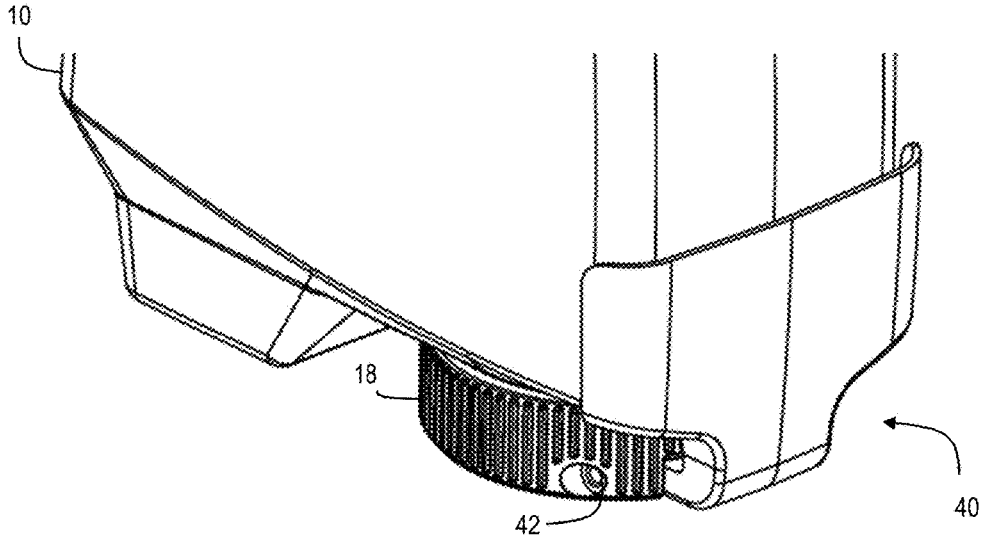
FIG. 6 is a perspective view of another embodiment of a particular container having a dispensing cap in a closed position according to the present invention.
Figure 7:
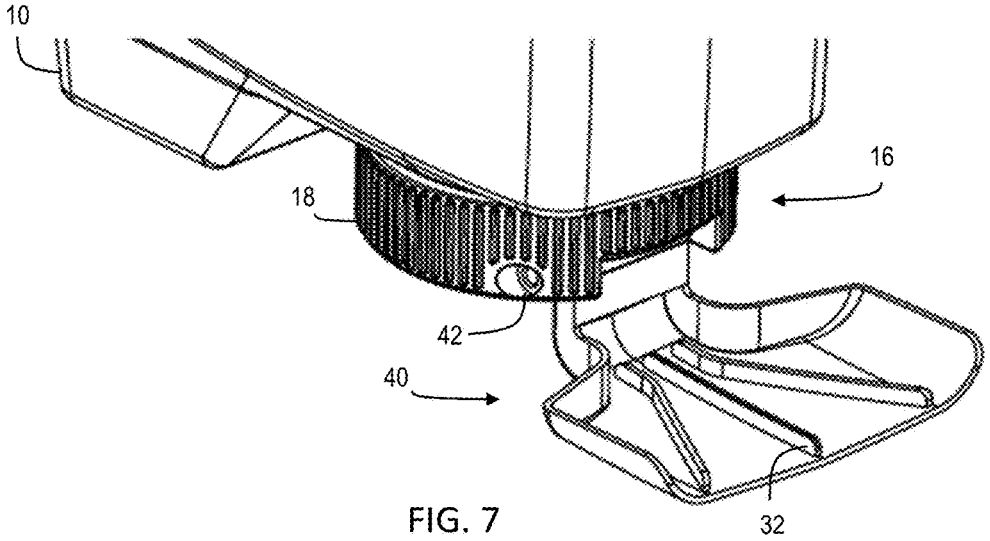
FIG. 7 is a perspective view of another embodiment of a particular container having a dispensing cap in an open position according to the present invention.
Figure 8:
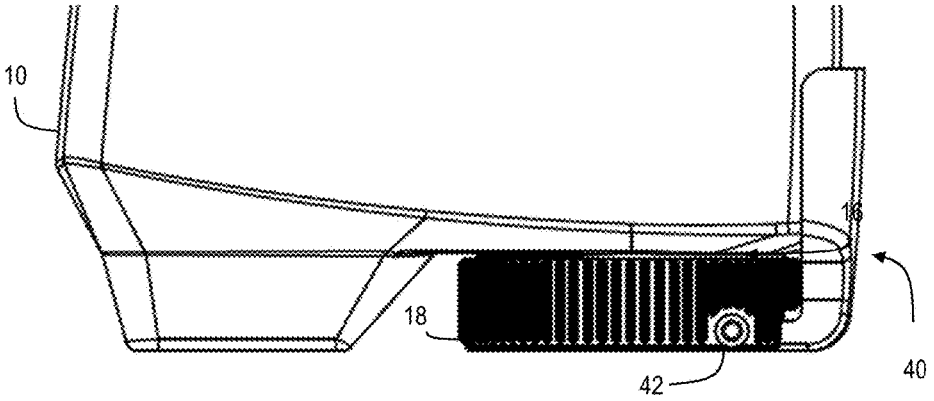
FIG. 8 is a bottom view of another embodiment of a particular container having a dispensing cap in a closed position according to the present invention.
Figure 9:
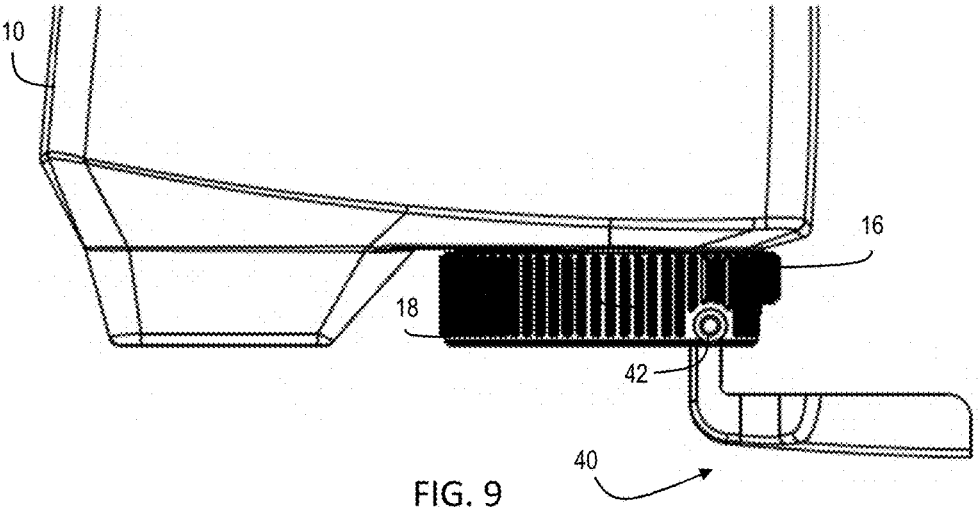
FIG. 9 is a bottom view of another embodiment of a particular container having a dispensing cap in an open position according to the present invention.
Figure 10:
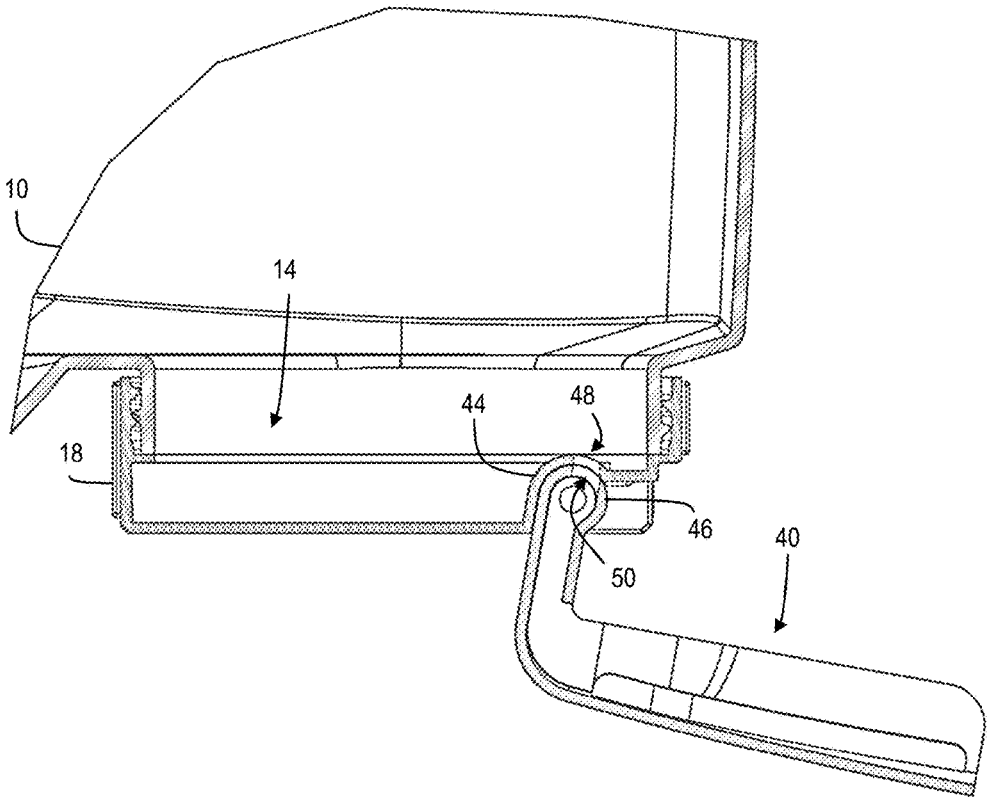
FIG. 10 is a cross section of a particular container having a dispensing cap according to the present invention.

Referring to FIGS. 6 through 8, in a second embodiment, cover 20 may comprise an L-shaped scoop 40 pivotally mounted to base 18 for movement between a closed position where scoop 40 is held closely along the bottom and side of container 10, and an open, dispensing position, where scoop 40 extends outwardly from container 10. Referring to FIG. 10, hinge 42 for scoop 40 is formed from a concave cavity 44 that extends laterally across base 18 and a barrel 46 formed in the hinge end of scoop 40 that is positioned with cavity 44 of base 18. Cavity 44 has a slot 48 formed through its inner wall that is in communication with opening 14 so that particulate can pass through opening 14 and then through slot 48. Barrel 46 of scoop 40 includes a corresponding slot 50 formed therethrough that is positioned to align with slot 46 of cavity 44 only when scoop 40 is in the open or deployed position, thereby allowing material to flow out of container 10 through slot 48 and slot 50 and across one side of scoop 40. When scoop 40 is in the closed position, slot 48 and slot 50 are misaligned so that no particulate can exit. Scoop 40 may also include a series of ribs 32 in communication with slot 50 to guide particulate flowing across scoop 40 for improved dispersal. Thus, scoop 40 extends along a plane that is perpendicular to the plane of base 18 when in the closed position and extends along a plane that is more closely parallel to base 18 when scoop 40 is in the open position.

The present invention thus provides a particulate container having an opening positioned at the bottom and a cover with a moveable lid for selectively opening and closing the opening of the container. When held by a handle in an upright position, the opening is positioned at the bottom of the container so that particular can be shaken and gravity fed out of the opening. The lid may have a cover that swings between closed and open positions and allows particulate to be fed from the container through a distribution channel when in the open position, or a scoop that pivots between a closed and open position and allows particular to be fed from the container through the hinge of the scoop when in the open position.

What is claimed is:

1. A dispensing cap for a container that holds particulate, comprising:

a base configured for removable attachment to a mouth of the container and having a port formed therethough for restricting the flow of particulate out of the container, wherein the base extends along a first plane defined by the mouth of the container and the cover is coupled to the base via a pivot so that the cover pivots along a second plane that is parallel to the first plane;

a cover pivotally mounted to the base and moveable between a first position, wherein the cover includes a channel that is misaligned with the port when the cover is in the first position and is aligned with the port of the base when the cover is in the second position and the cover is dimensioned to extend beyond the container to which base is attached when it is in the second position, wherein the cover prohibits particulate matter from exiting port of the base and a second position, wherein the cover permits particulate matter to exit the port of the base;

wherein the cover includes a series of ribs extending from a first position positioned proximately to the mouth of the container to a second portion positioned proximately to a peripheral edge of the cover and the series of ribs define a path for the flow of particulate that is parallel to the first plane.

2. The dispensing cap of claim 1, wherein the cover includes a dimple positioned between the series of ribs to redirect particulate that flows from the mouth of the container and across the cover.

3. A method of dispensing particulate from a container, comprising the steps of:

providing a dispensing cap on a mouth of the container, wherein the dispensing cap includes a base having a port formed therethough for restricting the flow of particulate out of the container, wherein the base extends along a first plane defined by the mouth of the container and the cover is coupled to the base via a pivot so that the cover pivots along a second plane that is parallel to the first plane, and a cover pivotally mounted to the base for movement between a first position, wherein the cover includes a channel that is misaligned with the port when the cover is in the first position and is aligned with the port of the base when the cover is in the second position and the cover is dimensioned to extend beyond the container to which base is attached when it is in the second position, wherein the cover prohibits particulate matter from exiting port of the base and a second position, wherein the cover permits particulate matter to exit the post of the base, wherein the cover includes a series of ribs extending from a first point proximate to the mouth of the container to a second point proximate to a peripheral edge of the cover and the series of ribs define a path for the flow of particulate that is parallel to the first plane;

moving the cover from the first position to the second position to at least partially open the container via the port of the base; and positioning the container so that the mouth of the container is pointed downwardly and gravity will feed any particulate in the container through the port of the base; and gently shaking the container to distribute particulate through the port of the base onto the cover of the dispensing cap.

4. The method of claim 3, wherein the step of moving the cover from the first position to the second position comprising pivoting the cap.

* * * * *